US007953335B2

(12) United States Patent
Kuwabara et al.

(10) Patent No.: US 7,953,335 B2
(45) Date of Patent: May 31, 2011

(54) IMAGE FORMING APPARATUS AND TANDEM IMAGE FORMING APPARATUS

(75) Inventors: Akitomo Kuwabara, Hitachiota (JP); Tsukasa Onose, Hitachinaka (JP); Sho Sawahata, Mito (JP); Yukio Otome, Ibaraki (JP); Akihiko Yamazaki, Hitachinaka (JP); Hiroyuki Mabuchi, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 538 days.

(21) Appl. No.: 12/047,859

(22) Filed: Mar. 13, 2008

(65) Prior Publication Data

US 2008/0226321 A1 Sep. 18, 2008

(30) Foreign Application Priority Data

Mar. 13, 2007 (JP) ..... 2007-063582
Mar. 10, 2008 (JP) ..... 2008-059142

(51) Int. Cl.
*G03G 15/16* (2006.01)

(52) U.S. Cl. ..... 399/66; 399/121; 399/297; 399/310

(58) Field of Classification Search ..... 399/66, 399/121, 297, 310
See application file for complete search history.

(56) References Cited

U.S. PATENT DOCUMENTS

| | | | | |
|---|---|---|---|---|
| 3,751,156 | A | 8/1973 | Szostak et al. | |
| 3,866,573 | A | 2/1975 | Szostak et al. | |
| 4,110,031 | A | 8/1978 | Ebi et al. | |
| 7,046,943 | B2 * | 5/2006 | Yamazaki | 399/176 |
| 2003/0133724 | A1 * | 7/2003 | Yoshida | 399/297 |
| 2004/0190952 | A1 * | 9/2004 | Tanimoto | 399/313 |
| 2007/0212130 | A1 | 9/2007 | Kuwabara et al. | |

FOREIGN PATENT DOCUMENTS

| | | |
|---|---|---|
| JP | S48-51640 | 7/1973 |
| JP | S52-042125 | 4/1977 |
| JP | 2007-047195 | 2/2007 |
| JP | 2007-199278 | 8/2007 |

* cited by examiner

*Primary Examiner* — Ryan D Walsh
(74) *Attorney, Agent, or Firm* — Oblon, Spivak, McClelland, Maier & Neustadt, L.L.P.

(57) ABSTRACT

An image forming apparatus has a photoconductive drum or belt supporting a toner image, a transfer member transferring the toner image onto a recording medium, a transportation device transporting the recording medium to between the photoconductor and the transfer member, a charger charging a surface of the transfer member to the anti-polarity of the electric charge of the toner image, a rotation drive unit rotating the transfer member to the same direction of the recording medium transportation, a contacting/removing unit that contacts the transfer member to the image supported member for printing and removes the transfer member from the image supported member when not printing, and a drive force transferring/blocking unit that transfers the drive force from the rotation drive unit to the transfer member before print starting-up and blocking the drive force during printing.

17 Claims, 7 Drawing Sheets

IMAGE FORMING APPARATUS AND TANDEM IMAGE FORMING APPARATUS

CROSS REFERENCE TO RELATED APPLICATIONS

This application is related to and claims priority under 35 U.S.C. §1.119 to Japanese Patent Application No. 2007-063582, filed on Mar. 13, 2007, and Japanese Patent Application No. 2008-059142 filed on Mar. 10, 2008, the entire contents of each are incorporated herein by reference.

BACKGROUND OF THE INVENTION

1. Field of the Invention

This present invention relates to an electrophotographic image forming apparatus, and more particularly relates to an image forming apparatus capable of forming a high-quality image without image defects even onto a rough surface sheet or a sheet wrinkled by heat, using a transfer unit having a roller-shaped or belt-shaped transfer member.

2. Description of the Related Art

A continuous form printer has often been used for computer output printing on business forms. Recently, the continuous form printer has also been used for various purpose printing of direct mail, invoices, manuals, books, and so on, by taking advantage of the features of a high speed variable information printer. With an increase in various uses, the continuous form printer is required to support various kinds of webs (recording medium) such as thin paper, thick paper, high-quality paper, and rough low quality paper.

Meanwhile, from a standpoint of saving resources, the needs of double-side printing are increasing. Double-side printing is performed by using two printers (tandem printer), a first printer prints on a first face of a web, the web is reversed, and the second printer prints on a second face of the web. In the case of various uses, the transfer performance is relevant to obtaining an image quality without image defects.

However, in tandem printing, a web may be damaged by heat from fixing at the first printer, and the web may become irregular (concavity and convexity) due to thermal shrinkage.

FIG. 9 is a schematic diagram of a tandem printing device capable of duplex printing on a continuous sheet. As shown in FIG. 9, the tandem printer has a first continuous sheet printer P1 forming a first image 70*a* on a first surface of a web 7 which is a continuous long-sheet, and a second continuous sheet printer P2 forming a second image 70*b* on a second surface of the web 7.

The continuous sheet printers P1 and P2 feed a recording medium at high speed (0.5-2 m/s) for printing. The recording medium has perforations between pages or is a roll sheet without perforations, and is different from cut sheets.

The first image 70*a* is formed on a side of the web 7 by the first printer P1 which has an image forming apparatus containing a developing unit 4*a* including a photoconductor 1*a*. The web 7 is reversed by a turn bar T. Then the second image 70*b* is printed on the other side of the web 7 by the second printer P2 which has an image forming apparatus containing a developing unit 4*b* including a photoconductor 1*b*.

Thus, in a case that images are printed on both sides of the web 7, image defects may be created when second images are formed by the second printer P2 on the other side of the web part which is stopped at area B in FIG. 9 where a fixing member fixing the image 70*a* on the web 7 is placed, for example.

FIG. 10 is a schematic enlarged diagram of the area B in FIG. 9 which shows the web-stop state of the fixing member.

As shown in FIG. 9, the fixing member includes a pre-heater 13 preheating the web 7, a heat roller 14 with a heater, and a backup roller 15 pressing the heat roller 14.

Both the pre-heater 13 and the heat roller 14 continue to supply heat to the web 7 during continuous printing. When the printing operation is stopped, the heaters are turned off. But, those heaters heated the web 7, because of natural cooling. Thus, parts of the web 7 on or near the pre-heater 13 shrink, for example, in the direction of the arrow in FIG. 10, and these heated parts create irregularities due to heat. Therefore, after printing is restarted, the parts of the web 7 having been stopped on the pre-heater 13 of the first printer P1 have image defects and are passed through an image forming area of the second printer P2.

In order to solve such a problem, for example, Japanese Unexamined Patent Application Publication No. 2007-47195 describes that a transfer-assist blade presses a web towards a surface of the photoconductor. By using the transfer-assist blade, a gap between irregularities of the web surface and a photoconductor can be decreased, and a good result for transferring may be obtained. However, in the case of double-side printing, toner images have already been formed on a first surface of a web, when toner images are printed on a second surface of the web. When the web is fed to a transfer member in a second printer, the surface contacting a transfer-assist blade is the first surface on which toner images have been formed on the web. The transfer-assist blade is run over a surface of toner image fixed at a first printer. Thus, some of the toner adheres to the transfer-assist blade and accumulates on the blade surface, thus causing degradation of images on the first surface.

Generally, when an image is printed on a second surface of a web, the pressure load by the transfer-assist blade is needed to be higher to improve adhesion. Because the web may be deformed by receiving heat during the fixing process for the first surface of the first printer, the transfer-assist blade is increasingly soiled.

As other transfer devices, a roller transfer system and a belt transfer system are well known, their mechanisms having been adopted by cut sheet printers in a slow-speed or a middle-speed range. For example, Japanese Unexamined Patent Application Publication No. S48-51640 describes that a transfer driven-roller is pressed to a web by a swing lever. The roller transfer system is able to decrease a gap between irregularities of a web surface and a photoconductor as described above, relative to noncontact corotron-transfer system because the transfer roller is contacted to a web at a moderate pressure. The roller transfer system supplies electric charges to a transfer roller in order to transfer a toner image developed on a photoconductor to a surface of a web by electrostatic force. As ways of supplying electric charge to a transfer roller, it is known to apply current to the cored bar of a transfer roller, and also known to apply electric charge to the surface of transfer roller having a dielectric layer surface.

The system of applying current to the cored bar of a transfer roller is adopted by cut sheet printers in a range of low or middle speed. A surface charge for transfer is increased as the printing speed increasing. Thus, the nip width between a transfer roller and a web needs to be extended. To extend a nip width, there are some methods of extending roller diameter, increasing thickness of the elastic member on a roller, or decreasing the hardness of the elastic member, etc. However, extending the roller diameter or increasing the thickness of elastic member needs more space, and decreasing the hardness of the elastic member causes an extension of a roller deforming and decreasing the life of the roller.

The system of applying electric charge to the surface of transfer roller can prevent extension of the transfer roller diameter or decreasing the life of the roller, because the nip width doesn't increase according to print speed, and the dielectric layer on the surface also serves as a protection layer. Regarding this system, for example, Japanese Unexamined Patent Application Publication No. S52-42125 describes that electric charges are supplied onto the surface of a transfer-roller (or belt). However, the system of applying electric charge to the surface of the transfer roller needs a charger for supplying electric charge and an eliminator for eliminating electric charge on the surface of a transfer roller. Thus, costs increase.

In a case of applying a transfer roller to a continuous sheet printer, the following factors need to be considered. A transfer roller is generally driven by a web. In case of using cut sheets, the transfer roller can contact a photoconductor or an intermediate transfer belt before printing. Because cut sheets as a web are separated from each other, and printing can be completed to the fixing process, it is unusual that a web stops having toner thereon in an unfixed-state inside the apparatus.

In the case of continuous sheet, printing may also stop during a print job. In that case, unfixed-state toner images may exist. A web is normally fed back enough pages to ensure an entrance length for the next printing. During the printing start-up process, the web is accelerated to a prescribed speed. Thus, in the case of continuous sheets, a contacting/freeing mechanism for a transfer roller is needed. Because the transfer roller needs to release from the web during the printing restart process to avoid image defects of the unfixed-state toner images. An operation of the contacting/freeing mechanism should be performed during the period of non-printing area from an end of the print-stop page to a top of the print-restart page.

In cases like this, when the system of applying current to the cored bar of a transfer roller as above is used, transfer performance will be unaffected because of current flowing constantly from inside the roller, if a rotation speed of the transfer roller lags behind a feed speed of the web. However, in the case of the system applying electric charge to the surface of transfer roller as above, in the print starting-up process, the electric charges are not applied on the surface between from the applying point of electric charge to the transfer point because the transfer roller is driven. Thus, in case that the transfer roller is driven, there is a problem that transferring cannot be performed when a print process starts up, and then, the following capability of the transfer roller is no good in a range of high-speed.

As described above, the continuous sheet printer is also expected to adopt to a wide variety of webs to respond to various purposes. The widths of the web are decided as usage. For example, if a photoconductor of the long length (from 21 to 22 inch) is used, the widths of the web range with 12 inch, 16 inch, 22 inch, etc. The widths of a web range from 12 to 16 inch in continuous form printing, and the widths of a web range with 17 inch being cut by 2 paper of A4 size, or with 22 inch being cut by 3 paper of B5 size in manual or document printing. Thus, when printing by using a web of narrow width, the part of the photoconductor without a sheet passing contacts the transfer roller directly. In this regard, for example, Japanese Unexamined Patent Application Publication No. S52-42125 describes the surface-speed of the transfer member is changed by using a switch. In a case that the transfer roller is driven, there is no problem that both the transfer roller and the photoconductor are the same in speed. However, if the transfer roller and the photoconductor are both driven, a short life span of the transfer roller and the photoconductor may be caused by the mechanical friction between surfaces. In the case of the continuous sheet printer as described above, the movement of the transfer roller needs to be performed in a short time. Otherwise, the image degradation such as character blur may be caused by vibration, because the more speed and the more weight of the transfer roller, the higher the inertia will be.

SUMMARY

A first aspect in accordance with the present invention provides an image forming apparatus having an image supported member supporting a toner image, a transfer member transferring the toner image on the image supported member onto a recording medium, a transportation unit transporting the recording medium to between the image supported member and the transfer member, a charger charging a surface of the transfer member to the anti-polarity of the electric charge of the toner image, a rotation drive unit rotating the transfer member to the same direction of the recording medium transportation, a contacting/removing unit that contacting the transfer member to the image supported member in printing and removing the transfer member from the image supported member without printing, a drive force transferring/blocking unit that transferring the drive force from the rotation drive unit to the transfer member before print starting-up and blocking the drive force in printing. The image forming apparatus includes the drive force transferring/blocking unit being an electromagnetic clutch between the rotation drive unit and the transfer member. The image forming apparatus includes the drive force transferring/blocking unit being configured that an outer roller capable of driven rotation in contact with the recording medium being transferred, and an inner roller rotating by drive force from the rotation drive unit, the outer roller and the inner roller being rotated with friction in the transfer member. The image forming apparatus includes the rotation drove unit starts rotating the transfer member and the charger starts charging the transfer member, before the transfer member contacts to the image support member via the recording medium. The image forming apparatus includes the charger being fixed in a position that is out of the way of the transfer member reciprocating and distanced a predetermined space from the transfer member contacting the image supporting member via the recording medium. The image forming apparatus comprises an elastic eliminator being fixed in a position that is out of the way of the transfer member reciprocating and distanced a predetermined space from the transfer member contacting the image supporting member via the recording medium. The image forming apparatus includes the transportation start timing of the recording medium by the transportation unit is synchronized with the rotation start timing of the transfer member by the rotation drive unit.

A second aspect in accordance with the present invention provides a tandem image forming apparatus comprises a first printer forming a first image, and a second printer forming a first image, wherein each first printer and second printer is implemented by the image forming apparatus above described.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE INVENTION

Figure 8:
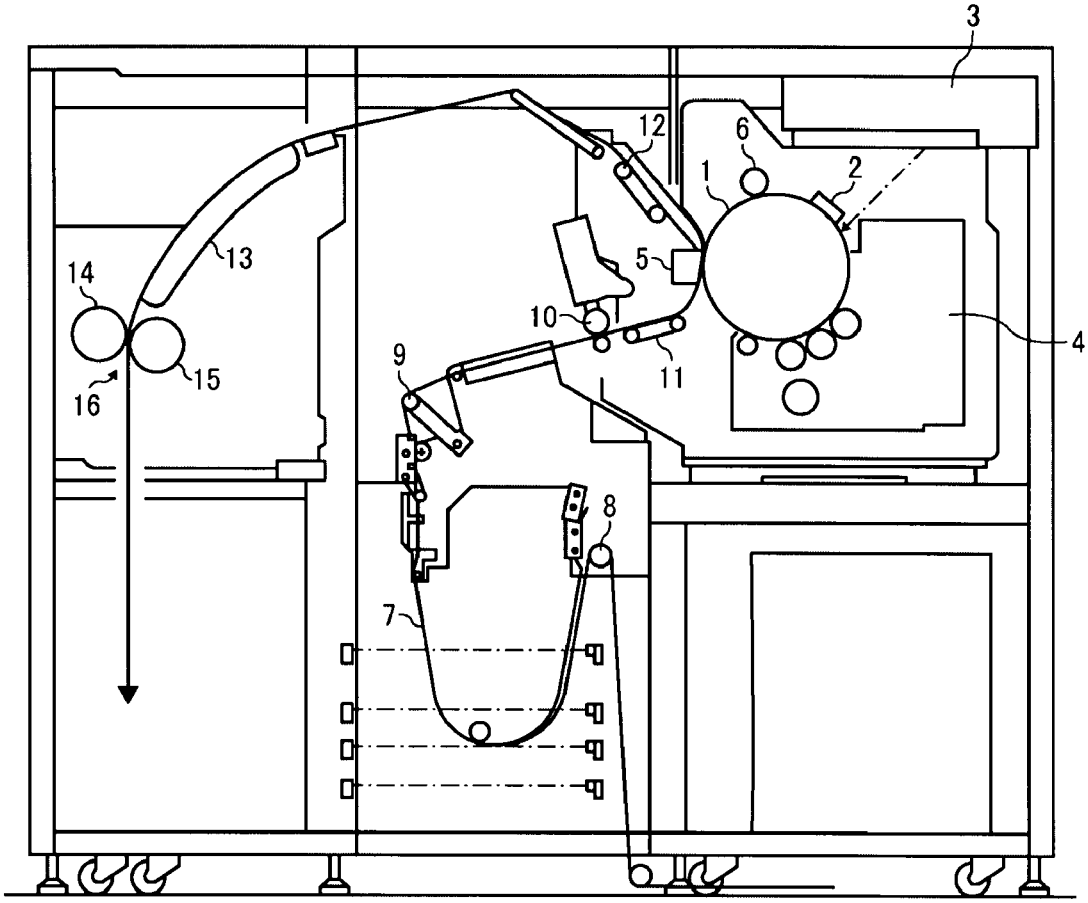
FIG. 8 is a schematic diagram showing an image forming apparatus according to the embodiments.
Figure 9:
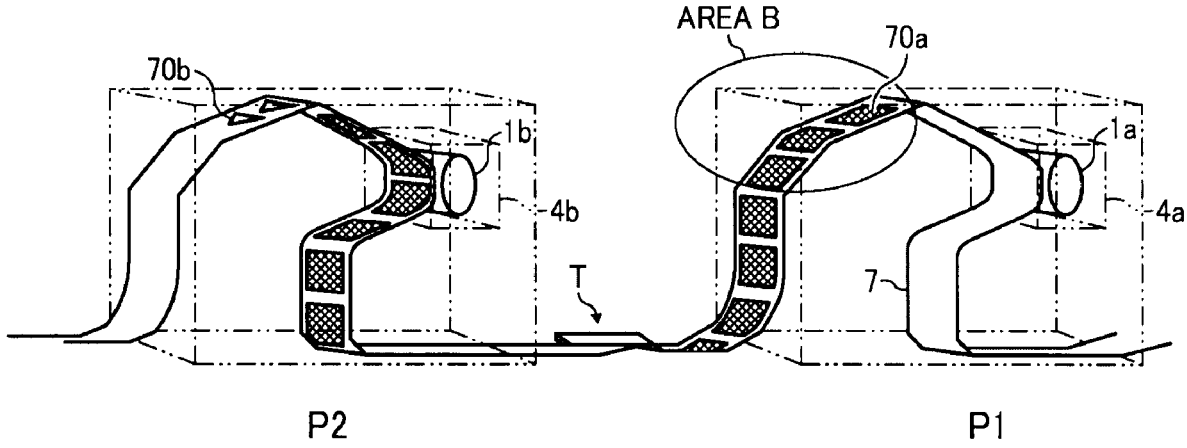
FIG. 9 is an explanatory diagram of tandem printing.
Figure 10:
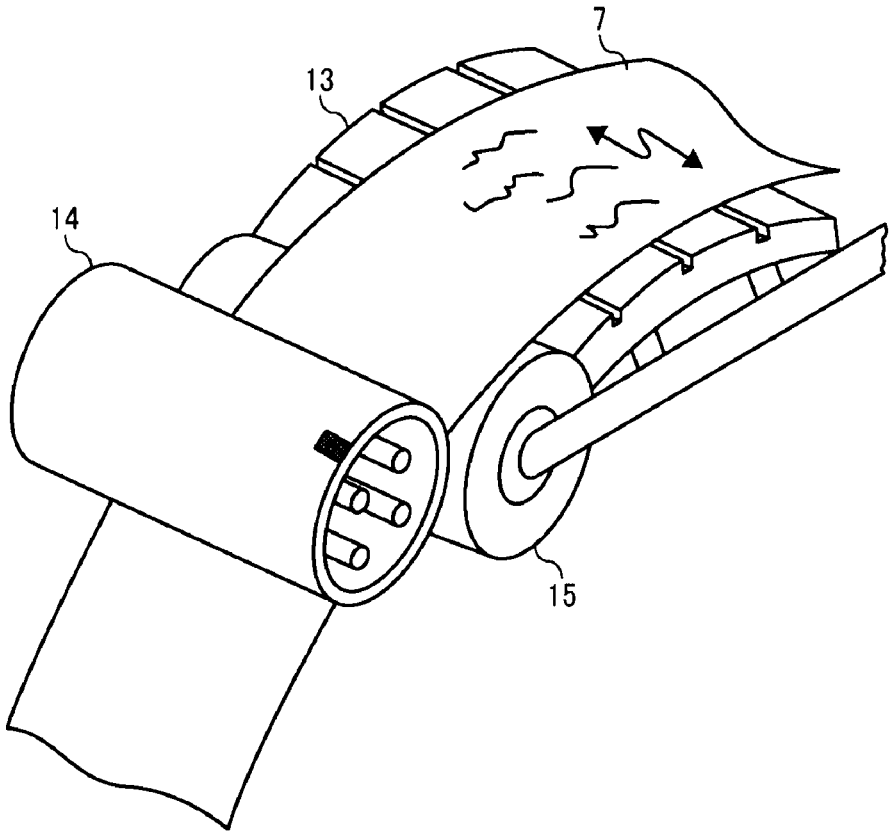
FIG. 10 is an explanatory diagram showing the state of a web which has stopped on a fixing unit upon stopping of printing.

Referring now to the drawings, wherein like reference numerals designate identical or corresponding parts throughout the several views and more particularly to FIG. 8 thereof, there is illustrated is a schematic diagram of an image forming apparatus according to the embodiments of the invention.

(1) Construction of Image Forming Apparatus

As shown in FIG. 8, a charger 2, an exposure device 3 such as a laser and rotating polygonal mirror, a developer 4, a transfer unit 5, a cleaning brush 6, etc., are arranged around a photoconductor 1 which may be implemented as a rotating photoconductive drum. After electric charges are uniformly imparted onto the surface of the photoconductor 1 by the charger 2, the exposure device 3 imparts laser beams according to image data onto the surface of the photoconductor 1, thus forming electrostatic latent images on the surface of the photoconductor 1. The developer 4 develops the images, thus forming toner images on the surface of the photoconductor 1.

The photoconductor 1 may be implemented using a positively-charged photoconductor such as selenium photoconductor, organic photoconductor (OPC), amorphous silicon (a-Si), etc. A development method of the photoconductor 1 is a reversal development method, for example, and a toner charged polarity is positive.

The web 7; implemented according to one embodiment, is a continuous sheet which is transported to the transfer unit 5 by the web transportation devices or rollers 8, 9, 10, 11 and 12, and a toner image is transferred to the web 7 by the transfer unit 5. After the toner image on the web 7 is heated to an approximately transition temperature of toner resin when passing through a pre heater 13, the toner image is fused and fixed onto the web 7 by a fuser 16 including a heat roller 14 containing a heater and a backup roller 15. In a case of duplex printing, two of the image forming apparatuses are used as shown in FIG. 8. The feature of the invention is in a constitution of the transfer unit 5 in accordance with this image forming apparatus. The transfer unit 5 is described as below.

(2) Constitution of Transfer Unit 5

Figure 1:
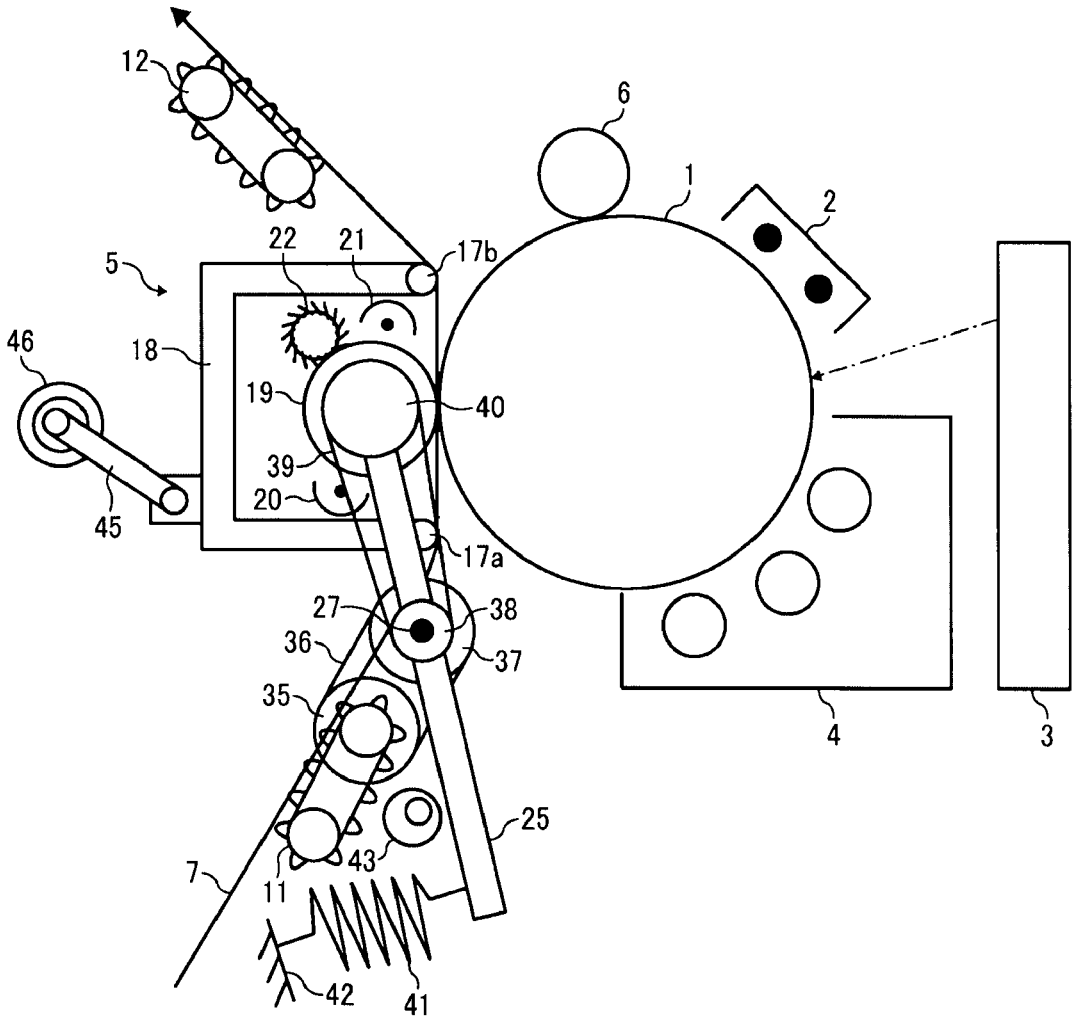
FIG. 1 is a schematic diagram showing a transfer unit in an image forming apparatus according to an embodiment of the invention.
Figure 2:
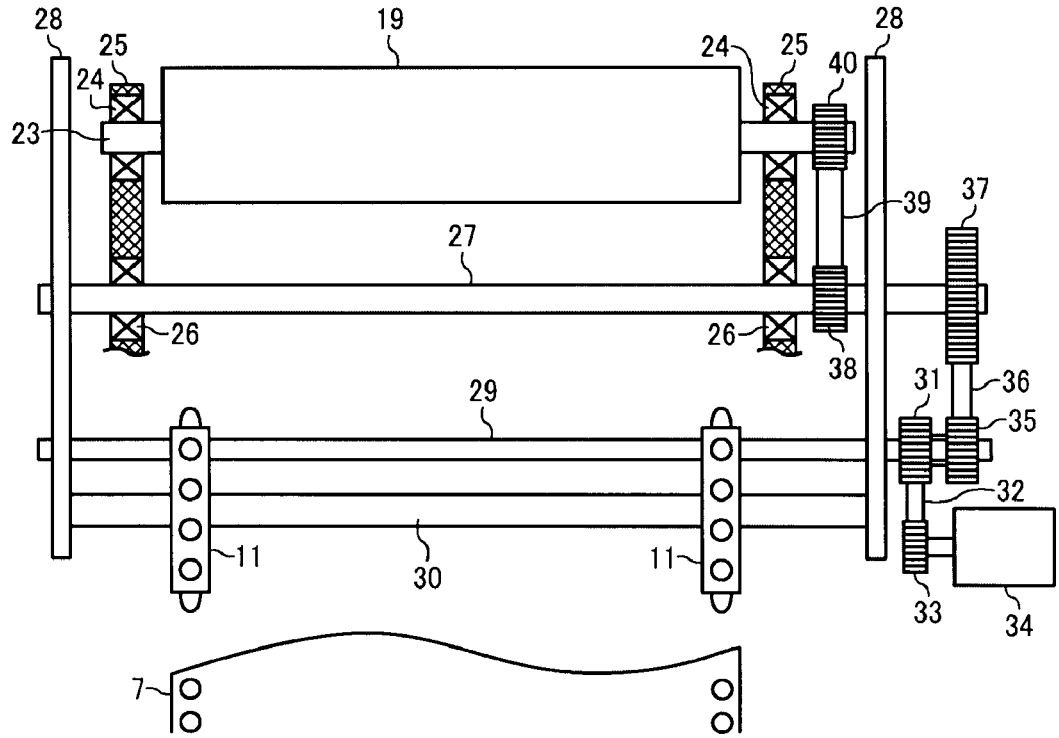
FIG. 2 is a schematic diagram showing a transfer roller driving part of the transfer unit according to the embodiment.

FIG. 1 is a schematic diagram of the transfer unit 5, and FIG. 2 is a schematic diagram of a transfer roller driving unit. As shown in FIG. 1, tractor-style web transportation devices 11 and 12 are located upstream and downstream of the transfer unit 5 in the direction of web transportation. The web 7 is fed in a prescribed direction by fitting sequentially the pin-feed holes of the web 7 with the rotating pins of the web transportation devices 11 and 12.

The transfer unit 5 has a transfer unit housing 18 containing a lower guide or roller 17*a* and an upper guide or roller 17*b* guiding the web 7 in the open end. There is a transfer roller 19 installed inside the transfer unit housing 18, a corona charger 20 applying electric charge to the transfer roller 19, a static eliminator 21 or discharger eliminating the surface of the transfer roller 19 after transferring, a brush-type cleaning member 22 for cleaning toner, dust, etc. from sheets which are on the surface of the transfer roller 19.

As shown in FIG. 1, the web 7 is transported from a tractor 11 to a tractor 12 over the lower guide 17*a* and the upper guide 17*b*.

The transfer roller 19 is constructed, according to one embodiment, of three layers including a surface layer made of a fluorinated nonconductive material, an intermediate layer being conductive elastic layer, and a base layer having a nonconductive elastic layer and metal cored bar. In this embodiment, the surface layer of the transfer roller 19 is formed by a tube of Tetra fluoro ethylene-perfluoro alkylvinyl ether copolymer (PFA), and the thickness is from 30 to 100 μm. In another embodiment, the transfer roller 19 may be made of a 2-layer constitution with a surface layer being coated by a nonconductive tube and an inner layer which is a conductive elastic layer.

As shown in FIG. 2, a transfer roller shaft 23 projecting from each end of the transfer roller 19 is rotatably supported by the ends of arms 25 via bearings 24. An intermediate portion of arms 25 is rotatably supported by an arm support shaft 27 via bearings 26. Thus, the transfer roller 19 is pivotally supported around the arm support shaft 27, and by pivoting about the arm support shaft 27, the roller 19 moves towards and away from the photoconductor 1, and the web 7 is pressed against and released from the photoconductor 1.

The ends of the arm support shaft 27 are rotatably supported by side panels 28 which are parallel to each other. Both a drive shaft 29 and a tractor shaft 30 rotatably supporting the web transportation device 11 are rotatably supported by the side panels 28.

A pulley 31 is mounted on one end of the drive shaft 29, the pulley 31 being connected to a driving side pulley 33 by a timing belt 32, and the driving side pulley 33 connects to an output shaft of a web transportation motor 34. An intermediate pulley 35 is also mounted on the drive shaft 29, the intermediate pulley 35 being connected to an intermediate pulley 37 fixed on one end of the arm support shaft 27 by a timing belt 36. Further, an intermediate pulley 38 is mounted on the arm support shaft 27, the intermediate pulley 38 being connected to a pulley 40 fixed on the end of the transfer roller shaft 23 by a timing belt 39.

Therefore, the rotary drive force of the web transportation motor 34 is transferred to the web transportation device 11 by the driving side pulley 33, the timing belt 32, the pulley 31, and the drive shaft 29. This rotary drive force is transferred to the arm support shaft 27 by the drive shaft 29, the intermediate pulley 35, the timing belt 36, and the intermediate pulley 37. Moreover, this rotary drive force is transferred to the transfer roller 19 by the intermediate pulley 38, the timing belt 39, the pulley 40, and the transfer roller shaft 23.

Thus, if the web transportation motor 34 rotates, the transfer roller 19 rotates in synchronization with the web transportation device 11. In this embodiment, the transfer roller 19 is driven by the web transportation motor 34 for the rotary drive, although any other drive source motor, or pulley may be used for the rotary drive.

As shown in FIG. 1, one end of a spring 41 is connected to the rear anchor side of the arm 25, and the other end of the spring 41 is connected to a fixed unit 42 which may be implemented as an anchor point which is stable during use. An eccentric cam 43 is mounted so as to contact and move the arm 25. The eccentric cam 43 is rotated at a predefined or desired time by a motor, and such rotation causes the arm to pivot about the shaft 27. The spring 41 is used to ensure a predefined or proper nip width between the photoconductor 1 and the transfer roller 19 by applying an appropriate pressure to the transfer roller 19, although it is possible for the invention to operate without the spring. The preferred pressure of the transfer roller 19 against the photoconductor 1 is from about 20N to 80N, for example. The pressure exerted by the spring is set depending on the length of the arm 25 such that the force of the transfer roller 19 against the photoconductor 1 is about 20N to 80N, although other values or ranges can be used, if desired. The eccentric cam 43 is used in cooperation with the spring 41 for the operation of contacting/removing of the transfer roller 19 to the photoconductor 1 and/or the web. This movement of the cam 43 by a motor causes the web to be sandwiched between the photoconductor 1 and the transfer roller 19. Next, a swing mechanism of the transfer unit housing 18 is described.

(3) Swing Mechanism of the Transfer Unit Housing 18

Figure 3A:
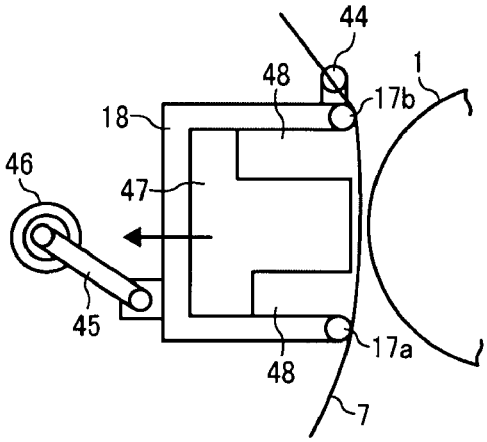
FIG. 3A is a schematic diagram explaining a swing mechanism of the transfer unit housing of the transfer unit according to the embodiment.
Figure 3B:
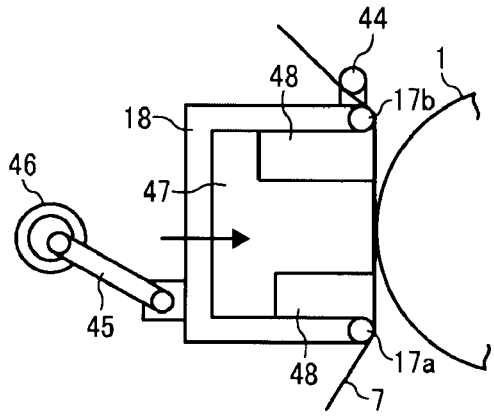
FIG. 3B is a schematic diagram explaining the swing mechanism of the transfer unit housing of the transfer unit according to the embodiment.

As shown in FIG. 3A and FIG. 3B, the transfer unit housing 18 is supported to swing about a shaft center 44 located at a top portion of the transfer unit housing 18. One end of a link 45 is connected to an outside wall of the transfer unit housing 18 which is opposite the photoconductor 1, and the other end of the link 45 is eccentrically-mounted on an output axis of a housing drive motor 46, or alternatively mounted to an eccentric cam. Thus, by rotating the housing drive motor 46, the transfer unit housing 18 swings about the shaft center 44.

As described above, in the case of the continuous sheet printer, both the web 7 and the transfer roller 19 need to be contacted and removed from the photoconductor 1 in a short time. The higher the speed of operation of contacting/removing and the more heavy the weight of the members, the more inertia becomes a concern. Moreover, the image degradation such as character blur may be caused by vibration. To solve these problems, in one embodiment, the corona charger 20, the static eliminator 21 and the cleaning member 22 are not moved, and only the transfer unit housing 18 supporting the web 7 and the transfer roller 19 are moved. As shown in FIG. 1, the corona charger 20, the static eliminator 21 and the cleaning member 22 are contained in the transfer unit housing 18. Then, as shown in FIG. 3A and FIG. 3B, some notches 48 are formed at positions facing the corona charger 20, the static eliminator 21 and the cleaning member 22, respectively, and on each side panel 47 of the transfer unit housing 18. Therefore, the transfer unit housing 18 can be moved without interference from 20, 21, and 22 which remain stationary.

Thus, the corona charger 20, the static eliminator 21 and the cleaning member 22 are, according to one embodiment, not attached to the transfer unit housing 18, and do not move as the housing moves, although this is not a requirement. Moreover, the transfer unit housing 18 is reduced in weight due to the notches 48. Therefore, the web 7 and the transfer roller 19 are able to move at high speed with less inertia and without image degradation. In FIG. 3A and FIG. 3B, to avoid a complicated drawing, the transfer roller 19, the corona charger 20, the static eliminator 21 and the cleaning member 22 are abbreviated. Next, the movement of the transfer unit 5 is described.

(4) Movement of the Transfer Unit 5

Figure 4B:
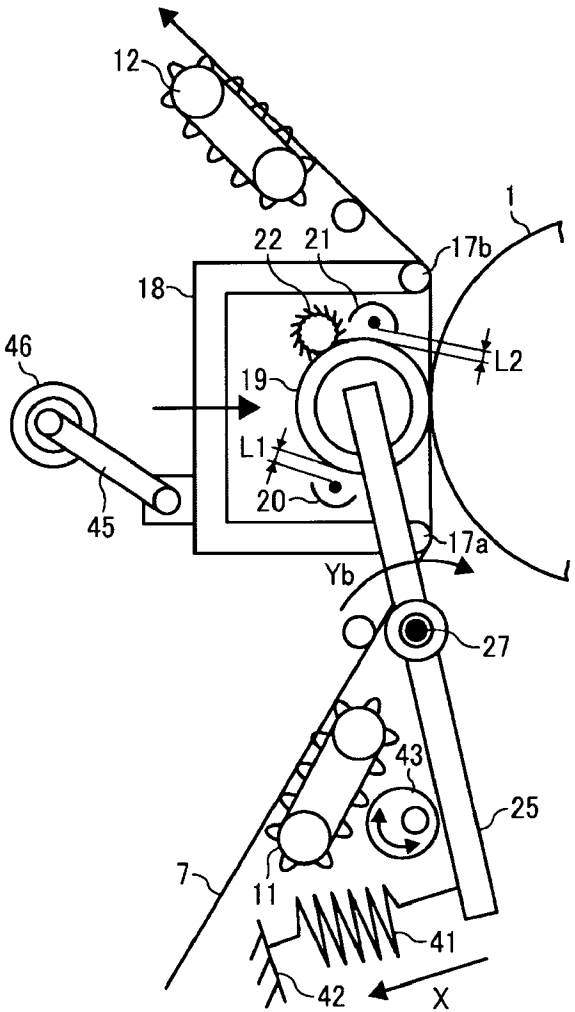
FIG. 4B is a schematic diagram explaining the swing mechanism of the transfer roller of the transfer unit according to the embodiment.
Figure 4A:
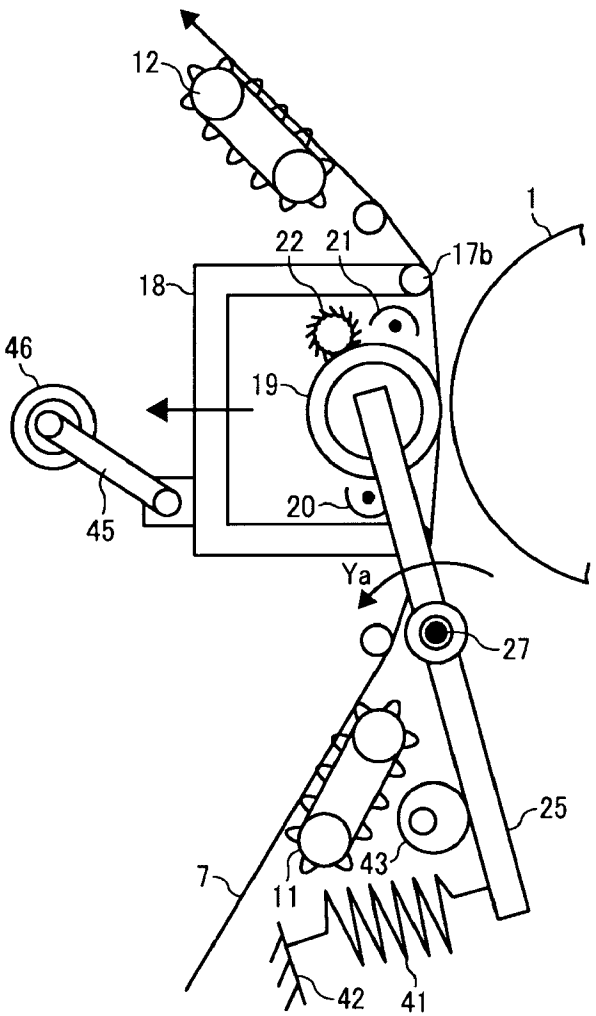
FIG. 4A is a schematic diagram explaining the swing mechanism of a transfer roller of the transfer unit according to the embodiment.
Figure 5:
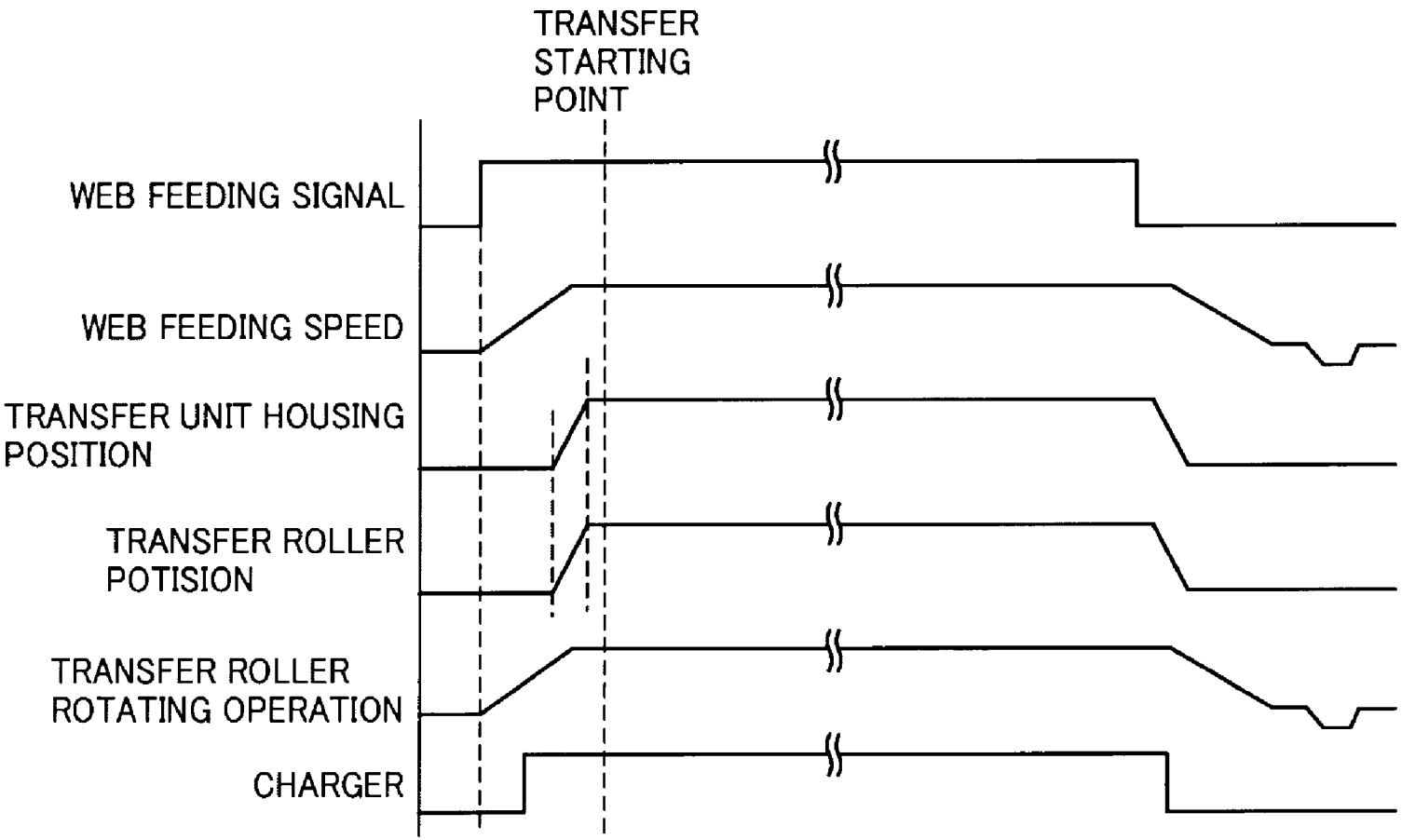
FIG. 5 is a timing chart explaining an each operation of the transfer unit.

FIG. 3A and FIG. 4A are cross sectional views showing the state of print waiting. FIG. 3B and FIG. 4B are cross sectional views showing the state of printing. FIG. 5 is a timing chart explaining the operation of the invention, and in particular the transfer unit 5.

For the print waiting state, the housing drive motor 46 rotates until the transfer unit housing 18 has been stopped in the position shown in FIG. 3A, and the transfer unit housing 18 and the web 7 are spaced from the photoconductor 1.

As shown in FIG. 4A, the eccentric cam 43 rotates and the major axis thereof pushes the rear anchor side of the arm 25 against the tension force of the spring 41. The arm 25 swings in the direction of an arrow Ya with a center around the arm support shaft 27. The transfer roller 19 is attached to the end of the arm 25. By swinging the arm 25, the transfer roller 19 is moved in the direction of the arrow Ya so that the transfer roller 19 is in a non-contact state with the photoconductor 1. In the non-contact state, the eccentric cam 43 stops rotating, and the print waiting state is sustained, as shown in FIG. 4A. The backward movement of the transfer unit housing 18 away from the photoconductor 1 by the housing drive motor 46, and the backward movement of the transfer roller 19 away from the photoconductor 1 by the eccentric cam 43 at the same time or approximately/substantially the same time, according to one embodiment.

The web transportation motor 34 is rotated by a web transportation start signal from a controller which may be implemented as a programmed microprocessor or an application specific integrated circuit, for example, and the driving of the web transportation device 11 and the transportation of the web 7 is started. As shown in the timing diagram of FIG. 5, the transportation speed of the web 7 rises up to predetermined or desired speed, preferably before the web 7 reaches the transfer point, and the preparation for the transfer operation is then completed. The transfer roller 19 and the web transportation device 11 start to rotate at the same time.

As shown in FIG. 5, the corona charger 20 switches ON slightly delayed from the transportation start timing of the web 7. A short time thereafter, signals are generated instructing the transfer unit housing 18 and the transfer roller 9 to start to move. As just one example, if the diameter of the transfer roller 19 is 40 mm in diameter, its circumference is 125.6 mm. The circumferential length between the point of the charger 20 and the transfer point is 41.9 mm (120 degrees). If an inlet length of the continuous sheet is shorter than 41.9 mm, it is possible not to use a delay time, if desired. On the other hand, if the inlet length is longer than 41.9 mm, then it is preferred to use a delay time. As shown in FIG. 3B, the housing drive motor 46 starts to rotate, the rotating drive force is transferred to the link 45, the link 45 pushes the transfer unit housing 18 towards the photoconductor 1. Subsequently, the web 7 contacts the photoconductor 1, and the rotating of the housing drive motor 46 stops.

At the same time (or substantially the same time) as the housing drive motor 46 starts to rotate, as shown in FIG. 4B, the eccentric cam 43 starts to rotate from the state of FIG. 4A, and then the arm 25 rotates in the direction of arrow X or Yb shown in FIG. 4B around the arm support shaft 27 due to contact with the eccentric cam 43. With this rotation, the transfer roller 19 swings towards the photoconductor 1, and the transfer roller 19 has an appropriate pressure by the pull force of the spring 41, and a predetermined nip width is created between the photoconductor 1 and the transfer roller 19.

As described above, in the case that the prescribed nip width is kept by pressing the transfer roller 19, as shown in FIG. 4B, the short axis (bottom dead point) of the eccentric cam 43 faces the arm 25. However, a slight gap is formed between the arm 25 and the eccentric cam 43, and the eccentric cam 43 may be in a non-contact state with the arm 25. A preferred size of the gap is from 0.3 mm to 2 mm, although the gap may be a different size, if desired. Thus, the pressure of the transfer roller 19 towards the photoconductor 1 is applied without operation of the eccentric cam 43 by only the spring 41, according to one embodiment.

As shown in FIG. 5, the swing movement of the transfer roller 19 and the transfer unit housing 18 finish at approximately the same time as the non-printing area of the web 7 reaches the transfer point. The non-printing area of the web is a region of a sheet on which information is not printed and it usually resides between the different pages making up the web. The swing movement of the transfer roller 19 preferably finishes, according to one embodiment, in the non-printing area between pages. The rotation of the transfer roller 19 and the transportation of the web 7 are at almost the same time, and the transfer roller 9 is rotating when it contacts the web 7. The corona charger 9 applying the electric charge to the transfer roller 9 is switched ON at a time the electric charges are already adopted on the surface of the transfer roller 19 when starting the transfer. Moreover, regarding the stopping of printing, the timing is the reverse of the starting of printing shown in FIG. 5.

In FIG. 4B, the distances L1 and L2 are the respective distances that the corona charger 20 and the static eliminator 21 are from the transfer roller 19 during the printing state. As one example, L1 is 8 mm, and L2 is 10 mm. The transfer roller 19 is preferably lightweight because the movement from the web 7 is preferred to be performed in a short time. The weight of moving elements including the transfer roller may be approximately 3 kg, for example. The weight of the non-moving parts such as the charger, eliminator (discharger), and cleaner is about 2.5 kg. Thus, the invention may permit the reduction of the movable weight by about half.

Therefore, in this embodiment, the corona charger 20, the static eliminator 21, and the cleaning 22 are placed out of the way of swing movement of the transfer roller 19. As described above, plural notches 48 are arranged in the transfer unit housing 18, and the corona charger 20, the static eliminator 21, and the cleaning member 22 are separated from the transfer unit housing 18 and are fixed. Thus, image degradation when emergency shut down or start-up can be decreased.

(5) Other Embodiment of the Transfer Roller Driving Unit

Figure 6:
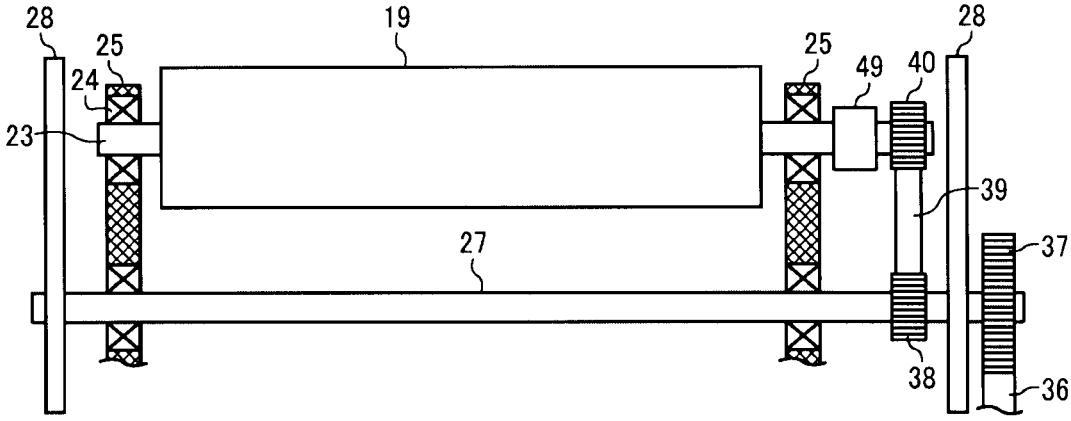
FIG. 6 is a schematic diagram showing a transfer unit according to another embodiment.

The invention has applicability to other types of transfer devices such as a transfer belt FIG. 6 is a schematic diagram of the transfer roller driving unit according to another embodiment. In this embodiment, a difference from the embodiment as shown in FIG. 2 is a driving force stopping unit 49 such as an electromagnetic clutch in the area of the transfer roller shaft 23 between the pulley 40 and the transfer roller 19.

When the speed of the web 7 and the transfer roller 19 is stable, the transferring of rotary drive force from pulley 40 is reduced or stopped by the drive force stopping unit 49, and the rotating of the transfer roller 19 is switched from being driven by the shaft to being driven by the movement of the web. Thus, the drive force stopping unit does not stop the roller 19, but stops a rotational force from the pulley 40 from driving the roller 19. This allows the roller 19 to rotate freely. When the printing stops, the transfer roller 19 is moved back and may continue to rotate by inertia, which is not a problem. The transfer roller may be stopped by connecting the drive force stopping unit 49, when the printing stops.

As described above, when the speed of the web 7 and the transfer roller 19 is stable, the rotary drive force is reduced or stopped by the drive force stopping unit 49. The transfer roller 19 is then rotationally driven by movement of the web 7. Then, the difference in speed between the transfer roller 19 and the web 7 can be zero. Thus, the life time of the transfer roller 19 will be extended.

In this embodiment, a transfer roller was used as the transfer member. However, this invention is not limited by this embodiment, and example.

(6) Alternative Embodiment of the Transfer Roller 19

Figure 7:
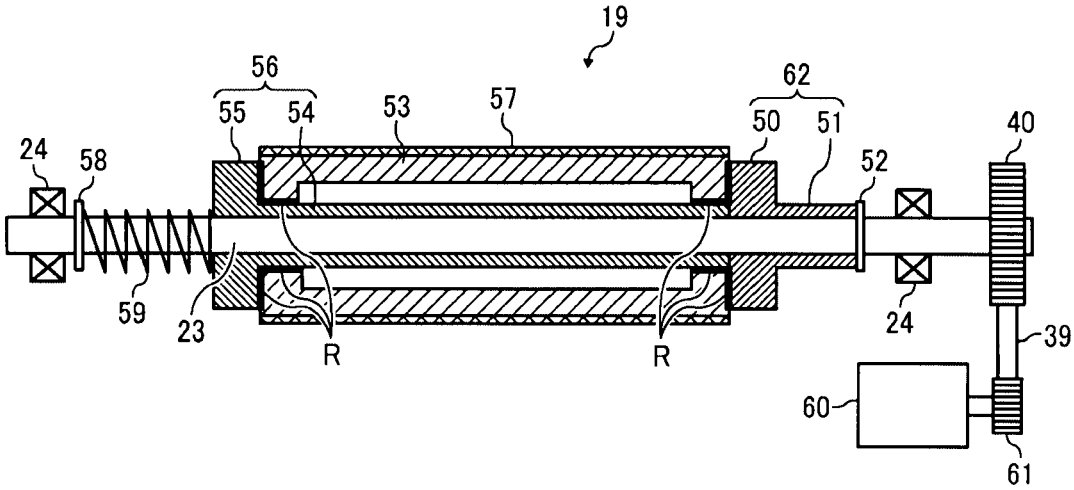
FIG. 7 is a schematic diagram showing a transfer roller according to another embodiment.

FIG. 7 is a schematic diagram showing a transfer roller 19 according to another embodiment. The transfer roller 19 has a combined transfer roller shaft and the transfer roller body.

In this embodiment, a first friction pulley 62 having a flange 50 and a tube 51 is at one end of the transfer roller shaft 23, and the first friction pulley 62 is fixed by a first stopper 52. A second friction pulley 56 having a flange 55 and a tube 54 is at the other end of the transfer roller shaft 23, and the second friction pulley 62 is fixed.

A transfer roller body 53 is disposed on the tube 54 periphery between the flange 50 and the flange 55. An outer surface of the transfer roller 53 is coated by a conductive layer 57 such as PFA.

A second stopper 58 is fixed in a outside direction on the axis of the transfer roller shaft 23. A coil spring 59 is placed between the friction pulley 56 and the second stopper 58.

The ends of the transfer roller shaft 25 are supported by bearings 24, a pulley 40 is at one end of the transfer roller shaft 25, the transfer roller shaft 23 and the friction pulleys 51 and 56 are rotated by the drive force from a drive motor 60, via a pulley 61 and the timing belt 39.

Thus, the friction pulleys 51 and 56 are applied with a force along the direction of the axis of rotation by the coil spring 59. If the friction pulley 51 and/or 56 rotate, the transfer roller body 53 is rotated by friction at the portions R, as shown in FIG. 7.

During printing, the surface speed Vr of the transfer roller 19 is configured to be load related and adopt the speed Vp of the web 7 and the photoconductor 1, when the web 7 and the photoconductor 1 connect/contact the transfer roller 19. Therefore, the transfer roller 19 is rotated by the drive motor 60 when printing, and the transfer roller 19 can be rotated at the same speed of the web 7 or the photoconductor 1 (Vr=Vp). Thus, this embodiment prevents the transfer roller 19 and the photoconductor 1 from having a reduced life time.

As an exemplary embodiment, assume the flanges 50 and 55 always rotate the same speed as the shaft 23. Also, the force of the spring acting against the flange 55 is Ps, the nip load or the force against the roller at the nip from the web (paper) or the photoconductor is Pr, the distance from the center of the shaft 23 to outer edge of the flange is Rb, the distance from the center of the shaft 23 to just below the horizontal portion R is Ra, the distance from the center of the shaft 23 to the outer surface of the roller 19 is Rc, $\mu 1$ is the coefficient of friction between the flange 50 and the transfer roller 53, $\mu 2$ is the coefficient of friction between the web 7 and the transfer roller 19. According to this example, the flange 50 and the transfer roller 53 rotate relative to one another (e.g., the flange 50 and the transfer roller 53 are not fixed with respect to each other) when the system is arranged according to the following formula:

$Pr/Ps>(2*Rb)/\{[(\mu2/\mu1)*Rc]-Ra\}$ where:

Pr=3000 g;

Ps=1000 g;

Rb=18 mm;

μ2=0.65;

μ1=0.22;

Rc=20; and

Ra=10.

In this embodiment, the movement of the transfer roller and the movement of the transfer unit housing have drive sources, respectively. However, only one drive source can also operate the movement of the transfer roller and the movement of the transfer unit housing. In this embodiment, both sides of the sheet are formed using two image forming apparatuses. However, only one side of the sheet can also be formed according to the present invention.

A controller may be implemented as a programmed microprocessor, CPU, processor, a controller, an application specific integrated circuit, chip, or using any other design or structure in order to control the various parts utilized by the invention. Further, the controller may be implemented using multiple controllers, and the term "controller" is intended to include multiple controllers and not be limited to a single controller.

Obviously, numerous modifications and variations of the present invention are possible in light of the above teachings. It is therefore to be understood that within the scope of the appended claims, the invention may be practiced otherwise than as specifically described herein.

The invention claimed is:

1. An image forming apparatus, comprising:

an image support member configured to support a toner image;

a transfer member configured to transfer the toner image on the image supported member onto a continuous web, the transfer member arranged to be rotationally driven and movable towards and away from the image support member;

a charger configured to charge a surface of the transfer member;

a controller configured to control a position of the transfer member relative to the image support member such that the transfer member is away from the image support member when not printing, and the transfer member is moved towards the image support member when printing such that the continuous web is sandwiched between the image support member and the transfer member, and the controller is configured to control a rotation of the transfer member such that the transfer member is rotated prior to the continuous web being sandwiched, wherein the transfer member comprises:

a roller which contacts and is configured to be driven by the continuous web, and is further configured to be driven by rotation occurring within the transfer member due to frictional contact with the roller, wherein the rotating of the roller is switched from being driven by a motor to being driven by the moment of the web when the speed of the continuous web and transfer roller is stable.

2. The image forming apparatus according to claim 1, further comprising:

an electromagnetic clutch connected to the transfer member which transmits a rotational force from a motor to the transfer member based on a signal from a controller.

3. The image forming apparatus according to claim 1, wherein:

the transfer member is configured such that the friction is overcome and the roller is driven at a speed of the continuous web, when the roller is driven by the continuous web.

4. The image forming apparatus according to claim 1, wherein:

the controller is configured to start the charger to charge the transfer member before the continuous web is sandwiched between the image support member and the transfer member.

5. The image forming apparatus according to claim 1, wherein:

the charger is positioned such that the transfer member is movable towards and away from the image support member under control of the controller while a position of the charger remains constant.

6. The image forming apparatus according to claim 5, further comprising:

a discharger which discharges the image support member, the discharger positioned such that the transfer member is movable towards and away from the image support member under control of the controller while a position of the discharger remains constant.

7. The image forming apparatus according to claim 1, wherein:

the controller is configured to synchronize a starting of movement the continuous web with a rotation of the transfer member.

8. The image forming apparatus according to claim 1, further comprising:

a motor configured to rotate the transfer member; and a cam configured to move the transfer member towards and away from the image support member.

9. The image forming apparatus according to claim 1, wherein:

the image support member comprises a photosensitive material.

10. The image forming member according to claim 1, wherein:

the controller is a single controller.

11. The image forming member according to claim 1, wherein:

the controller comprises a plurality of controllers.

12. A tandem image forming apparatus comprising:

a first printer forming a first image; and a second printer forming a second image, wherein at least the second printer is implemented using the image forming apparatus according to claim 1.

13. The image forming apparatus according to claim 1, wherein the roller of the transfer member comprises:

a shaft configured to be driven by the motor; and an outer roller around the shaft configured to rotate with the shaft due to a frictional force, and configured to rotate relative to the shaft when the frictional force is overcome.

14. The image forming apparatus according to claim 13, wherein:

a relationship between a coefficient of friction μ1 between the shaft and the outer roller and a coefficient of friction μ2 between the outer roller and the continuous web is:

$\mu1<\mu2$.

15. An image forming apparatus, comprising:

means for supporting a toner image;

a transfer means for transferring the toner image on the means for supporting a toner image onto a continuous web, the transfer means arranged to be rotationally driven and movable towards and away from the means for supporting a toner image;

a charger configured to charge a surface of the transfer means;

means for controlling a position of the transfer means relative to the means for supporting such that the transfer means is away from the means for supporting when not printing, and the transfer means is towards the means for supporting when printing such that the continuous web is sandwiched between the means for supporting and the transfer means, and for controlling a rotation of the transfer means such that the transfer means is rotated prior to the continuous web being sandwiched, wherein the transfer means comprises:

a roller which contacts and is configured to be driven by the continuous web and is further configured to be driven by rotation occurring within the transfer means due to frictional contact with the roller, wherein the rotating of the roller is switched from being driven by a motor to being driven by the moment of the web when the speed of the continuous web and transfer roller is stable.

16. The image forming apparatus according to claim 15, wherein the transfer means comprises:

a shaft configured to be driven; and an outer roller around the shaft configured to rotate with the shaft due to a frictional force, and configured to rotate relative to the shaft when the frictional force is overcome.

17. The image forming apparatus according to claim 16, wherein:

a relationship between a coefficient of friction $\mu 1$ between the shaft and the outer roller and a coefficient of friction $\mu 2$ between the outer roller and the continuous web is:

$\mu 1 < \mu 2$.

* * * * *